United States Patent [19]

Longbottom et al.

[11] Patent Number: 4,819,824

[45] Date of Patent: Apr. 11, 1989

[54] LIDDED CONTAINERS

[75] Inventors: Karl Longbottom, Burton-on-Trent; Norman Whiteley, Walsall; Paul J. H. Bagnall, NR. Rugeley, all of England

[73] Assignee: Barker, Brettell & Duncan, Edgbaston, England

[21] Appl. No.: 159,697

[22] Filed: Feb. 24, 1988

[30] Foreign Application Priority Data

Feb. 25, 1987 [GB] United Kingdom ..... 8704434

[51] Int. Cl.[4] ..... B65D 41/48

[52] U.S. Cl. ..... 220/266; 220/306

[58] Field of Search ..... 220/306, 266, 270, 277; 150/55

[56] References Cited

U.S. PATENT DOCUMENTS 4,397,404 8/1983 Blanchette ..... 220/306
4,520,943 6/1985 Nielsen ..... 220/306 X
4,711,364 12/1987 Letica ..... 220/306 X

FOREIGN PATENT DOCUMENTS 2100239 12/1982 United Kingdom ..... 220/306

*Primary Examiner*—Donald F. Norton

[57] ABSTRACT

A lidded container is provided which is intended to deter unauthorized removal of the lid. The container has an out-turned lip of inverted U-section having a circumferential horizontal flange supporting an upright retention portion with a retaining bead. The lid has a rim portion which is also of inverted U-section, the web of the U having a formation engaging a complementary formation on the lip of the container to provide location and sealing connection between the lid and container, and the outer limb being outwardly cranked and forming a depending skirt having a retaining formation which interlocks with the retaining formation.

Part of the flange is extended to form a tab which is removable at a line of weakening to facilitate separation of the lid and container. Removal of the tab indicates that the container has been opened or at least that it has been tampered with.

3 Claims, 3 Drawing Sheets

LIDDED CONTAINERS

This invention relates to lidded containers and more especially to such containers which are designed to deter, and show evidence of, tampering with their lids.

Lidded containers which are made of plastics material usually have a lip which is turned over outwards, and is commonly of an inverted U-section. Their mating lids have a rim including a skirt which surrounds the lip. It is common, also for the rim to be of an inverted U-section to push over the lip of the container so as to engage both inside and outside the lip. An air-tight seal can be achieved in this manner between the lid and the container.

When lidded containers are used to hold foodstuffs and other products for sale it is desirable that unauthorised opening should be deterred not only to try to stop pilfering but also to prevent damage to or deterioration of the contents. It is important for it to be evident when unauthorised opening of a container has occurred, even if the lid has been replaced.

According to the present invention a lidded container is provided the lid of which has a skirt which surrounds a rim of the container, the container having a circumferential flange which extends underneath the skirt and has an upstanding retention portion which surrounds at least a lower portion of the skirt, and the skirt and retention portion having formations which mechanically interlock to retain the lid positively on the container.

Either one of, or both, the container and the lid may be of plastics material.

Preferably the retention portion and the formations extend continuously around the container. A portion of the flange, or at least its retention portion, may be made to be severable or removable, for example by the provision of a line or lines of weakening so as to enable the mechanical interlock to be released. The arrangement has the advantage of deterring unauthorised opening, and of showing by the severing or removal of the said portion when the container has been opened. The entire flange or retention portion may be made to be removable but it is more convenient for just a portion to be removed. An interlocking engagement can still be obtained then between the skirt and the retention portion which, though more easily released, can nevertheless serve a useful purpose in retaining the lid on the container again after the initial opening.

The flange may form a continuation of a turned-over lip of the container.

The rim may be of an inverted generally U-section, the skirt being presented by an outer limb of the U-section.

Where the container has a turned-over lip and the rim is of inverted U-section the web portion of the rim and an adjacent portion of the lid may have complementary male and female locating formations to assist in locating the lid on the rim of the container. If the lid is made of a plastics material such formations can be useful in reinforcing the resistance to unintentional release of the mechanical interlock between the skirt and the retention portion, for example as a result of pressure being exerted on the central part of the lid, as when the container is stacked with others; which might tend to distort the lid. The locating formations may comprise a circumferential bead of angular, conveniently rectangular, section on the one and a complementary groove in the other.

The interlocking formations of the skirt and retention portion may be co-operating male formations such as beads or analogous projections which interengage, or they may be co-operating male and female formations, such as a bead and recess.

The container may be of circular or non-circular shape.

An embodiment of the invention will now be described by way of example only with reference to the accompanying drawings in which.

Figure 5:
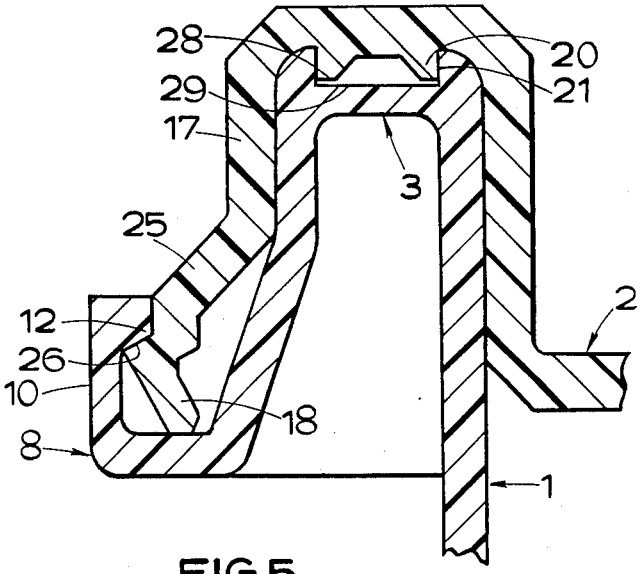
Figure 6:
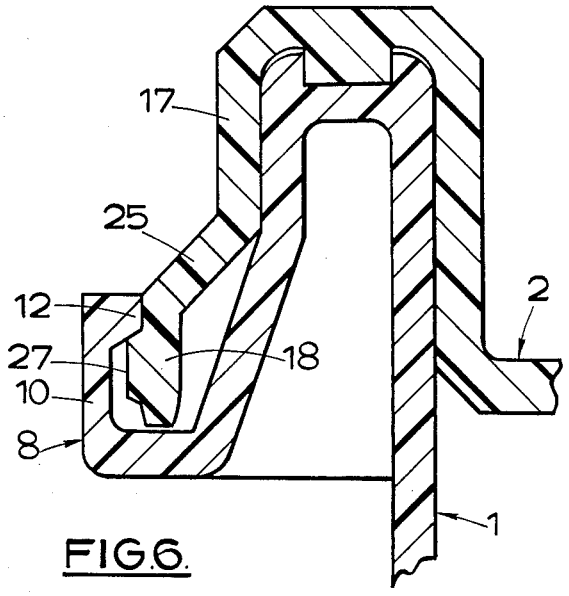

FIGS. 5, and 6 are fragmentary sections showing modifications.

In this embodiment the invention is applied to a rectangular lidded container. Both the container 1 and its lid 2 are made as plastics mouldings. The container 1 may be made of a high density polyethylene or a polypropylene, and the lid 2 may be made of a low density polyethylene or a polypropylene. They may be made of other suitable plastics materials.

Figure 1:
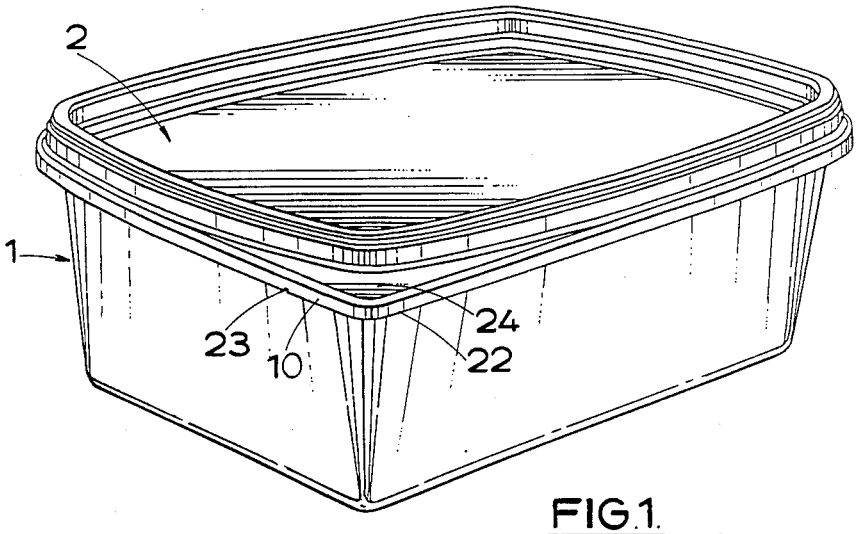
FIG. 1 is a top perspective view of a lidded container in accordance with the present invention.

Referring to FIG. 1, the container 1 has an outwardly turned lip 3 which has a lateral portion 4 and a depending portion 5 spaced from the circumferential wall 6 of the container. A lower part 7 of the depending portion 5 is outwardly inclined and is then extended outwards to form a circumferential L-shaped flange 8 which has a horizontal base limb 9 and an upright leg 10. At angularly spaced positions around the container there are reinforcing webs 11 between and joined integrally to the circumferential wall 6 and the depending portion 5 of the lip. The leg 10 of the flange, which constitutes a retention portion of the flange, is spaced outwardly from the outwardly inclined lower part 7 of the depending portion 5. An inwardly-directed retaining bead 12 at the upper end of the leg 10 extends continuously around the container. The retaining bead 12 has an under face 13 shallowly inclined downwards to the inside surface of the leg 10.

The lid 2 has a rim 14 of inverted generally U-section comprising a web 15 and inner and outer limbs 16 and 17 respectively. The outer limb 17 has an outwardly cranked lower part which forms a circumferential skirt 18. On the outside of the skirt 18 there is a retaining bead 19 having bevelled upper and under faces the upper face being inclined similarly to the under face 13 of the retaining bead 12 on the leg 10 of the flange 8. The lid pushes over the lip 3 of the container. The lateral portion 4 and the upper part of the depending portion 5 of the lip locate inside the U-section of the rim in close contact with the web 15 and upper part of the outer limb 17 of the U-section, the adjacent part of the circumferential wall 6 being in close contact with the inner limb 16. The skirt 18 locates between the outwardly inclined lower part 7 of the lip 3 and the leg 10, the retaining bead 12 of the latter engaging over the retaining bead 19 of the skirt to provide a mechanical interlock which positively holds the lid on the container. In that condition the bottom edge of the skirt seats on the base limb 9 of the flange 8. There is sufficient resilience in the flange to allow it to be deflected sufficiently for the retaining beads to be interengaged and then to return to its normal state to hold them securely interlocked. The webs 11 resist distortion of the depending portion 5 of the lip 3.

A locating bead 20 of rectangular section on the underside of the web 15 engages in a complementary groove 21 in the lateral portion of the lip. Thus a good sealing connection is made between the lid and the container. The interengagement between the locating bead 20 and the groove 21 locates the rim on the lip and resists disconnection as a result of pressure being applied to the central part of the lid.

Figure 3:
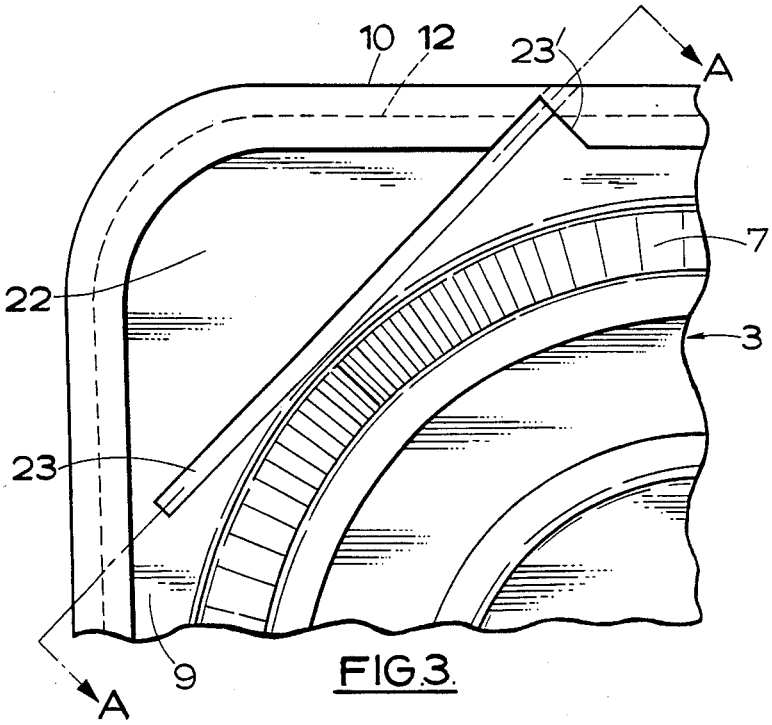
FIG. 3 is a fragmentary plan view of a corner of the container incorporating a tab.
Figure 4:
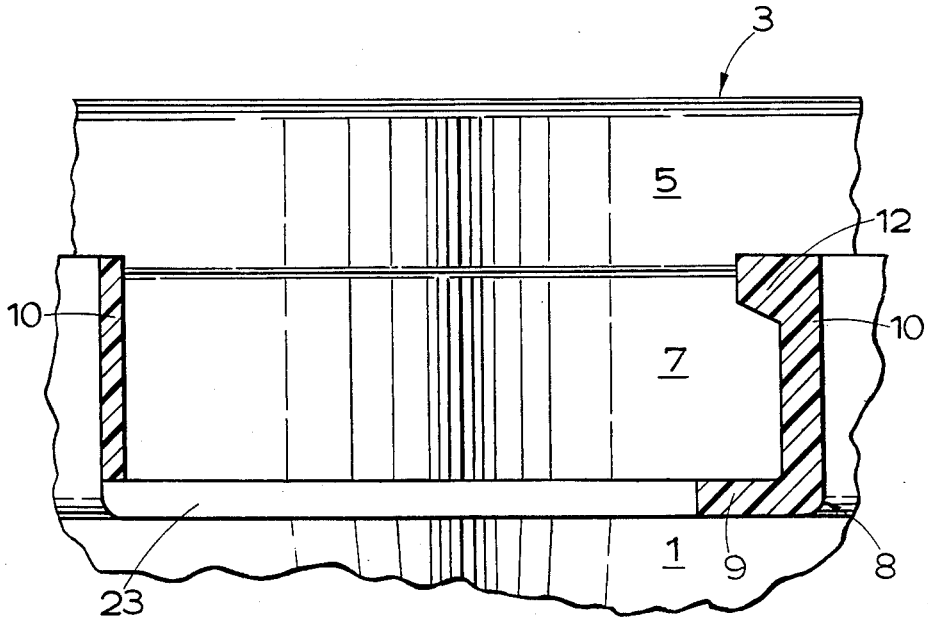
FIG. 4 is a section along the line AA in FIG. 3.

At one corner of the container the base limb 9 of the flange 8 is extended outwardly to form a tab 22, FIGS. 1 and 3. The leg 10 and its retaining bead 12 are continued around the tab 22. A line of weakening is defined diagonally across the corner portion of the flange, at the root of the tab 22, by a slot 23 in the base limb which, as shown in FIGS. 3, 4, penetrates beneath the leg 10 of the flange at one side of the corner portion and extends almost to the leg at the other side of the corner portion. A V-section groove 23' extends the line of weakening upwards into the leg 10 of the flange and its bead 12 to facilitate disengagement of the interlocking retaining formations. The outer limb 17 of the rim 14 of the lid is similarly extended at the corresponding corner of the lid to form a tab 24, FIG. 1, which overlies the tab 22 of the container and around which the skirt 18 is continued. The line of weakening enables the tab 22 of the container to be separated from the flange at least at the leg 10, at the groove 23', by cutting or tearing, for access to be gained to the tab 24 of the lid so that it can be manipulated to peel the lid off the container from that corner, the interlocked retaining beads 12,19 being progressively disengaged as the lid is lifted.

Because the skirt and initially the leg 10 extend continuously around the container, when their retaining beads are interlocked and the flange is intact it is difficult to release the lid from the container. A sufficient extent of the beads cannot readily be disconnected by distortion of the intact flange whilst the necessary upward force is simultaneously applied to the skirt to release the lid. Therefore as long as the flange is intact unintentional release of the lid is resisted and tampering is deterred. Only when the tab 22 has been separated at least partially from the flange can the lid be readily released. Once the tab has been separated there is, of course, visual evidence that the container has been opened, or at least that an attempt has been made to open it.

The retaining bead 12 on the leg 10 of the remaining part of the flange 8 will interlock with the retaining bead 19 on the skirt when the lid is re-fitted on the container.

Figure 2:
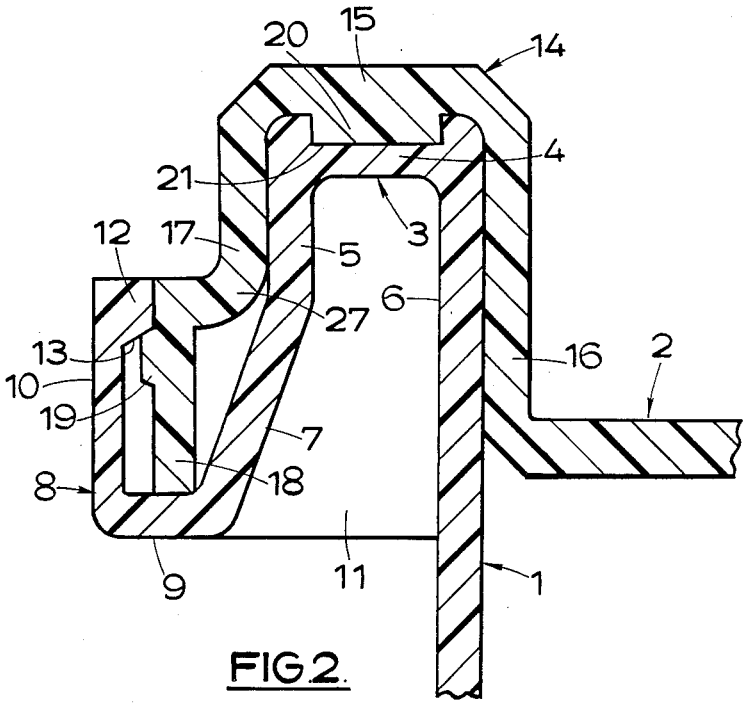
FIG. 2 is an enlarged fragmentary section through a part of the container.

In the modifications shown in FIGS. 5 and 6 of the drawings, the leg 10 of the flange 8 is shorter than that in the embodiment described and as shown in FIG. 2. In each case the skirt 18 is at the lower end of an outwardly and downwardly inclined part 25 of the outer limb 17 of the rim 14 of the lid 2 of the lip 3 of the container. The modification shown in FIG. 5 has a step 26 in the skirt 18 which engages under the retaining bead 12 of the leg, and the skirt 18 is inwardly inclined below the step so that the lower end of the skirt is disposed inwardly of the retaining bead 12 and is able to pass the bead without interference, thereby facilitating insertion of the skirt past the bead. In the modification shown in FIG. 6, the skirt 18 depends parallel to the leg 10 and it has a retaining bead 27 which is deeper than that on the skirt in the embodiment described. A further modification in FIG. 5 is that the locating bead 20 is hollowed at an outer face 28 which lies adjacent an inner face 29 of the groove 21 on the lip 3 of the container.

We claim:

1. A lidded container comprising a container having a rim and a lid having a skirt which surrounds said rim and has a lower portion, said rim being of an inverted generally U-section including an outer depending limb having an outwardly and downwardly inclined lower portion from which a circumferential flange extends outwards underneath said skirt, said circumferential flange having an upstanding retention portion which surrounds said lower portion of said skirt, said skirt and said retention portion having mechanically interlocked formations which extend continuously around said container, said flange being formed with a line of weakening and said retention portion having a portion adjacent to said line of weakening which is separable at least partially from the remainder of said flange at said line of weakening to enable the mechanical interlock between said formations to be released.

2. A lidded container according to claim 1 wherein a portion of said flange is extended outwards from said container to form a tab around which said retention portion extends and said lid has an associated portion which is correspondingly increased such that said lid forms a complementary tab around which said skirt extends and wherein said line of weakening is formed at said tab-forming portion of said flange such that said portion can be removed, thereby leaving said associated tab-forming portion of said lid accessible for assisting subsequent separation of said lid from said container.

3. A lidded container according to claim 1 wherein said U-shaped section of said rim has a web portion, said lid has an adjacent portion and complementary male and female locating formations are provided at said web portion and said adjacent portion which assist in locating said lid on said rim and provide a sealing engagement between said lid and said rim.

* * * * *

UNITED STATES PATENT AND TRADEMARK OFFICE

CERTIFICATE OF CORRECTION

PATENT NO. : 4,819,824

DATED : April 11, 1989

INVENTOR(S) : Karl Longbottom, Norman Whiteley, Paul James H. Bagnall

It is certified that error appears in the above-identified patent and that said Letters Patent is hereby corrected as shown below:

On the Title Page, Item [73] should read

-- [73] Assignee: Peerless Plastics Packaging, Ltd.
Tamworth,
Staffordshire,
England --.

Signed and Sealed this

Seventh Day of November, 1989

*Attest:*

JEFFREY M. SAMUELS

*Attesting Officer*

*Acting Commissioner of Patents and Trademarks*